US007434490B2

(12) United States Patent
Hayashi

(10) Patent No.: US 7,434,490 B2
(45) Date of Patent: Oct. 14, 2008

(54) TURNING DRIVE APPARATUS FOR MODEL, AND SLIP GEAR APPARATUS

(75) Inventor: Ryoji Hayashi, Tokyo (JP)

(73) Assignee: Konami Corporation, Tokyo (JP)

( * ) Notice: Subject to any disclaimer, the term of this patent is extended or adjusted under 35 U.S.C. 154(b) by 691 days.

(21) Appl. No.: 10/510,185

(22) PCT Filed: Jul. 26, 2004

(86) PCT No.: PCT/JP2004/010978

§ 371 (c)(1),
(2), (4) Date: Nov. 17, 2004

(87) PCT Pub. No.: WO2005/009575

PCT Pub. Date: Feb. 3, 2005

(65) Prior Publication Data

US 2005/0066768 A1 Mar. 31, 2005

(30) Foreign Application Priority Data

Jul. 28, 2003 (JP) ..... 2003-281310

(51) Int. Cl.
*F16H 1/02* (2006.01)

(52) U.S. Cl. ..... 74/412 TA; 464/41

(58) Field of Classification Search ..... 74/412 TA; 464/30, 37, 41

See application file for complete search history.

(56) References Cited

U.S. PATENT DOCUMENTS 2,544,809 A * 3/1951 Stanley ..... 192/48.91
4,702,122 A * 10/1987 Richard ..... 74/412 TA
5,000,721 A * 3/1991 Williams ..... 464/37
5,170,676 A * 12/1992 Matouka et al. ..... 74/411
5,601,491 A * 2/1997 Chan et al. ..... 464/37
6,389,917 B1 * 5/2002 Oberle ..... 74/412 TA
6,508,140 B2 * 1/2003 Zaps ..... 74/411
6,725,994 B2 * 4/2004 Bacon ..... 192/223

FOREIGN PATENT DOCUMENTS

JP 2726838 B2 3/1998
JP 2782172 B2 7/1998
JP 2001-280897 A 10/2001

OTHER PUBLICATIONS

International Search Report in Japanese for PCT/JP2004/010978 mailed Oct. 26, 2004.
Patent Abstracts of Japan for JP2726838 published on Mar. 11, 1998.
Patent Abstracts of Japan for JP2782172 published on Jul. 30, 1998.
Patent Abstracts of Japan for JP2001-280897 published on Oct. 10, 2001.

* cited by examiner

*Primary Examiner*—David M Fenstermacher
(74) *Attorney, Agent, or Firm*—Darby & Darby P.C.

(57) ABSTRACT

In a turning drive apparatus (10) for turning a movable portion (3) of a model (1) by transmitting power from a drive source to the movable portion (3) through a gear train (11), a pair of gears (16, 17) included in the gear train (11) are coupled concentrically with each other through a common slip plate (18). A friction transmitting portion (30) is arranged by combining at least any one (17) of the gears with the slip plate (18) so that it makes a slip motion to the slip plate (18) in a circumferential direction.

2 Claims, 5 Drawing Sheets

TURNING DRIVE APPARATUS FOR MODEL, AND SLIP GEAR APPARATUS

CROSS-REFERENCE TO PRIOR APPLICATION

This is a U.S. national phase application under 35 U.S.C. §371 of International Patent Application No. PCT/JP2004/010978 filed Jul. 26, 2004, and claims the benefit of Japanese Patent Application No. 2003-281310 filed Jul. 28, 2003 which is incorporated by reference herein. The International Application has not published as of the date of filing of this application.

TECHNICAL FIELD OF THE INVENTION

The present invention relates to a turning drive apparatus for turning a movable portion of a model, and to a slip gear apparatus used in the turning drive apparatus.

BACKGROUND OF THE INVENTION

In general, a conventional turning drive apparatus used to turn a turret of a tank model transmits rotation of a motor as a drive source to an internal gear in the turret through a gear train. However, even if a tank model has a turret turning drive apparatus assembled therein, a user sometimes tries manually turning the turret. In this case, the turret cannot be easily turned due to a resistance of the turning drive apparatus, and when the turret is forcibly turned, there is a possibility that the gear train and the like are damaged.

To cope with the above problem, there is provided a turning drive apparatus in which the tooth profile of a drive gear meshed with an internal gear disposed in a turret is formed in a small size so that a tooth slip occurs between the internal gear and the drive gear meshed therewith when a user manually turns the turret to reduce a resistance when the turret is manually turned as well as protect the turning drive apparatus from an excessive torque.

SUMMARY OF THE INVENTION

However, a problem arises in the method for using the tooth slip when the tank model is reduced in size. When the size of the model itself is reduced, the tooth profile itself of the internal gear assembled in the turret is absolutely reduced. In contrast, since the machining accuracy of parts is unchanged even if the size of the model is reduced, the ratio of a tooth profile error to a tooth profile size relatively increases. Accordingly, the differences between products increase in excess of the size range of the tooth profile in which the tooth slip occurs, and thus there may frequently occur abnormality in that the tooth slip does not sufficiently occur when the turret is turned manually or the tooth slip occurs when the turret is turned by the power from the drive source. To avoid the above disadvantage, the accuracy of gears must be enhanced, which results in an inevitable increase in manufacturing cost. This problem may occur not only in the turret of the model but also in various movable portions to be turned. A turn torque is exerted on a movable portion not only manually but also when the movable portion is turned by other power source, and the same problem arises also in the latter case.

Accordingly, an object of the present invention is to provide a turning drive apparatus that can ease a requirement for the accuracy of parts as compared with a conventional turning drive apparatus that permits a movable portion to turn making use a tooth profile and to provide a slip gear apparatus used in the turning drive apparatus.

An embodiment of the present invention solves the above problem by the following means.

A turning drive apparatus for a model according to an embodiment of the present invention for turning a movable portion of the model by transmitting power from a drive source to the movable portion through a gear train includes a friction transmitting portion interposed between a pair of gears included in the gear train, the friction transmitting portion transmitting rotation making use of a friction force.

According to the turning drive apparatus, when a turn torque resulting from a power other than the power from the drive source is exerted on the movable portion, a slip motion occurs in the friction transmitting portion to permit the movable portion to rotate as well as the transmission of an excessive torque from the friction transmitting portion to the drive source is prevented so that the turning drive apparatus can be protected. Whether or not the slip motion occurs in the friction transmitting portion is determined by a static friction force exerted on the friction transmitting portion. However, even if the static friction force somewhat disperses, any serious problem does not occur as to power transmission such as a problem of faulty gear mesh which would be caused by different sizes of a gear tooth profile. Therefore, a requirement for accuracy of gear parts is eased as compared with a case that the tooth slip is utilized.

In a preferable embodiment of the turning drive apparatus of the present invention, the pair of gears may be coupled with each other concentrically through a common slip plate, and at least any one of the pair of gears may be combined to the slip plate so that the gear makes a slip motion in a circumferential direction, thereby the friction transmitting portion may be interposed between the gear and the slip plate.

According to this aspect, the occurrence of the slip motion between the slip plate and the gear permits the movable portion to turn. Since the friction transmitting portion is interposed between the pair of gears disposed concentrically in the gear train, even if the friction transmitting portion is added, the number of shafts of the gear train does not increase, thereby the gear train can be arranged compact.

Further, a hollow portion may be formed on a center side of any one of the pair of gears and the slip plate may be engaged with an inner periphery of the hollow portion, a radially deformable spring portion may be disposed on a center side of the slip plate, and the other gear of the pair of gears may be engaged with an inner periphery of the spring portion of the slip plate.

According to this aspect, the pair of gears can be held concentrically by the slip plate as well as a friction force can be generated between the slip plate and the other gear by pressing the spring portion of the slip plate against the other gear by the force of the spring portion of the slip plate. As a result, the slip plate can act as means for concentrically holding both the gears and forming the friction transmitting portion, thereby the size of the pair of gears is restricted to the size of an apparent gear device molded integrally and concentrically. Accordingly, the turning drive apparatus can be prevented from being increased in size by the addition of the friction transmitting portion.

In other embodiment of the turning drive apparatus of the present invention, a friction wheel may be coupled with any one of the pair of gears to be concentrically rotated together with the gear, and the other gear of the pair of gears may contact with an outer peripheral surface of the friction wheel, thereby the friction transmitting portion may be interposed between the friction wheel and the other gear.

According to this aspect, a slip motion between the friction wheel and the outer periphery of the other gear permits the movable portion to turn. Since the friction wheel and one of the gears can be concentrically coupled with each other so that they can be rotated together, it is not necessary to generate a slip motion in a circumferential direction therebetween. Accordingly, a part including one of the gears and the friction wheel can be manufactured with relative ease.

Further, when the outer periphery of the friction wheel is made of an elastic member to be elastically deformed when the outer peripheral surface contacts with the other gear, a friction force, which is sufficient to transmit the power from the drive source between the friction wheel and the other gear, can be generated making use of a restoring force resulting from the elastic deformation. Since an impact and a fluctuation of torque exerted between the one of the gears and the other gear can be eased by the deformation of the elastic body, the movable portion can be smoothly turned.

A slip gear apparatus according to an embodiment of the present invention disposed in a gear train for turning a movable portion of a model by transmitting power from a drive source to the movable portion includes a slip plate and a pair of gears being coupled concentrically with each other through the slip plate, wherein at least any one of the pair of gears is combined to the slip plate so that the gear makes a slip motion in a circumferential direction, and a friction transmitting portion is interposed between the gear and the slip plate. Further, in the slip gear apparatus according to an embodiment of the present invention, a hollow portion may be formed on a center side of any one of the pair of gears, the slip plate may be engaged with an inner periphery of the hollow portion, a radially deformable spring portion may be disposed on a center side of the slip plate, and the other of the pair of the gears may be engaged with an inner periphery of the spring portion of the slip plate.

According to these slip gear apparatuses, by the mentioned reasons, the gear train can be arranged compactly, thereby an increase in size of the turning drive apparatus can be prevented even if the friction transmitting portion is additionally provided.

As described above, according to the embodiment of the present invention, it is permitted to manually turn the movable portion making use of the slip motion in the friction transmitting portion as well as the turning drive apparatus is protected by preventing the transmission of the excessive torque to the drive source side further than the friction transmitting portion. Accordingly, the requirement for accuracy of the gear parts can be eased as compared with the case that the tooth slip is utilized. Therefore, the manufacturing cost of the model can be reduced.

BEST MODE FOR CARRYING OUT THE INVENTION

First Embodiment

Figure 1:
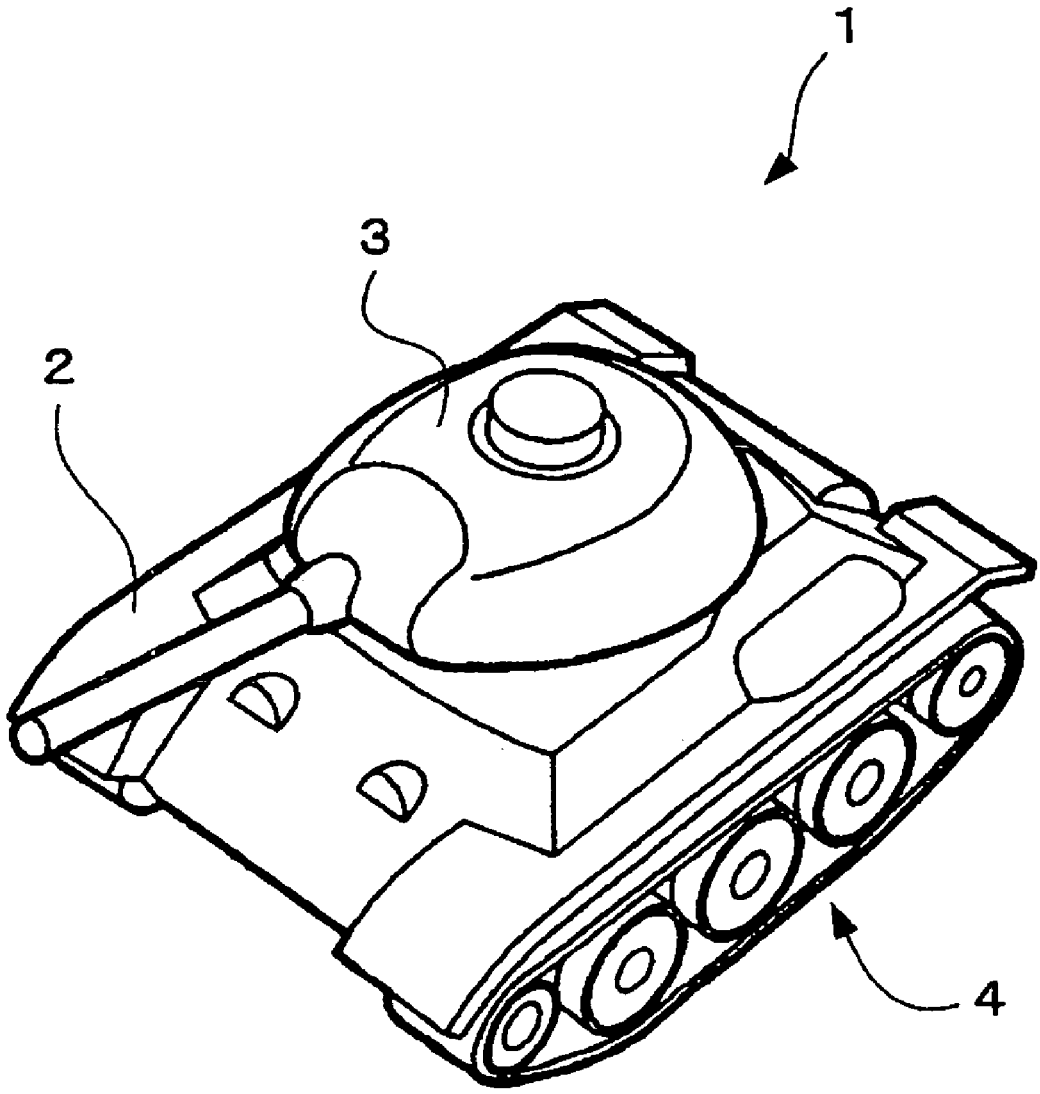
FIG. 1 is a perspective view showing an outside appearance of a tank model to which an embodiment of the present invention is applied.

FIG. 1 shows a tank model 1 to which a turning drive apparatus according to an embodiment of the present invention is applied. The tank model 1 includes a body 2, a turret 3, and traveling units 4, the turret 3 being capable of turning horizontally with respect to the body 2, and the traveling units 4 being disposed on both the sides of the body 2 (only one side of the body 2 is shown in the figure). The respective movable portions of the tank model 1 are remotely manipulated in response to a control signal transmitted from a not shown controller. The turret 3 is one of the remotely manipulated movable portions, and the turning drive apparatus according to an embodiment of the present invention is applied to turn the turret 3. Traveling of the tank model 1 executed by the traveling units 4 and other remote manipulations executed thereto are out of the embodiment of the present invention, the explanation thereof is omitted.

Figure 2:
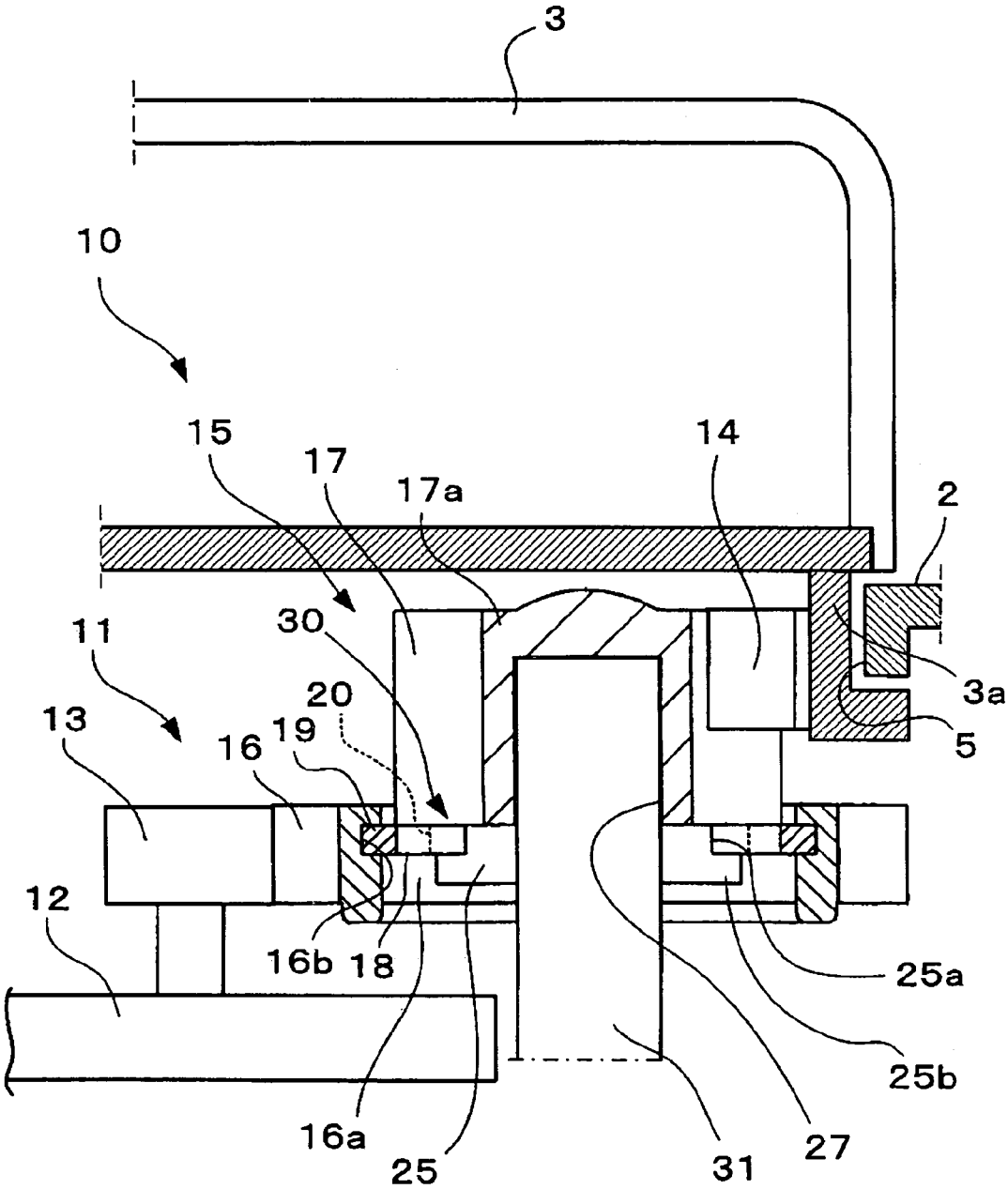
FIG. 2 is a sectional view showing a main portion of a turret turning drive apparatus assembled in the tank model shown in FIG. 1.

FIG. 2 shows a main portion of a turning drive apparatus 10 of the turret 3. The turning drive apparatus 10 transmits power from a not shown drive source (electric motor) to the turret 3 through a gear train 11. The turret 3 is turnably supported by a journal 3*a*, which is formed under a lower end of the outer periphery of the turret 3 and rotatably engaged with a bearing 5 of the body 2, thereby the turret 3 turns within a horizontal plane (when the tank model 1 is placed on a horizontal surface). The gear train 11 includes an intermediate gear 12, a pinion 13, an internal gear 14, and a slip gear apparatus 15. The pinion 13 can be concentrically and integrally rotated together with the intermediate gear 12, the internal gear 14 is disposed internally of the journal 3*a* of the turret 3 so as to rotate integrally together with the turret 3, and the slip gear apparatus 15 is interposed between the pinion 13 and the internal gear 14.

Figure 3:
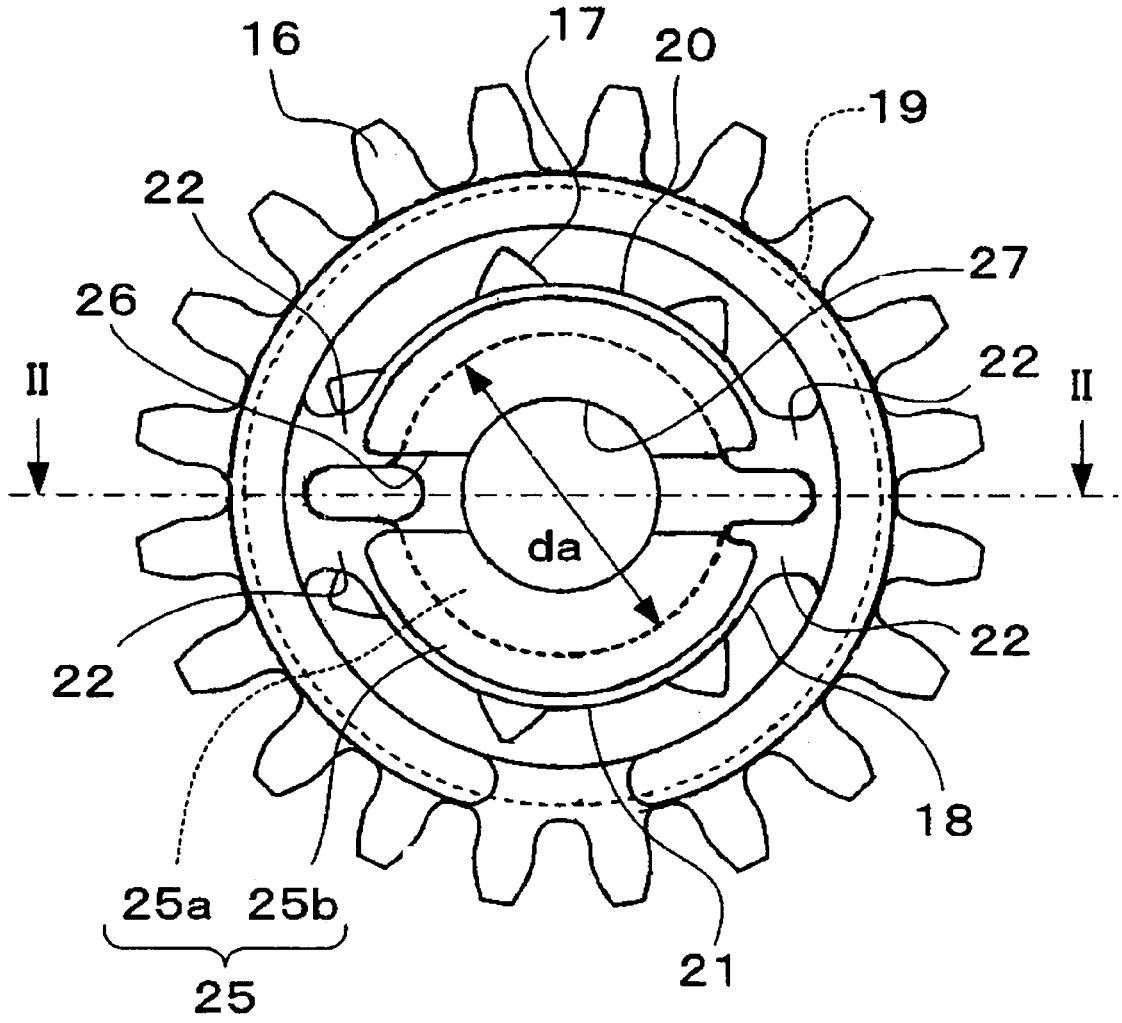
FIG. 3 is a view showing a slip gear apparatus assembled in the turret turning drive apparatus when it is observed from a lower side of FIG. 2.

As also shown in FIG. 3, the slip gear apparatus 15 includes a driven gear 16 meshed with the pinion 13, and a pinion 17 disposed concentrically with the driven gear 16 and meshed with the internal gear 14 (refer to FIG. 2). Note that FIG. 2 shows a sectional view of the slip gear apparatus 15 taken along the line II-II of FIG. 3. A hollow portion 16*a* is formed on the center side of the driven gear 16, and a slip plate 18 is engaged with a groove 16*b* formed around the inner periphery of the hollow portion 16*a*.

Figure 4:
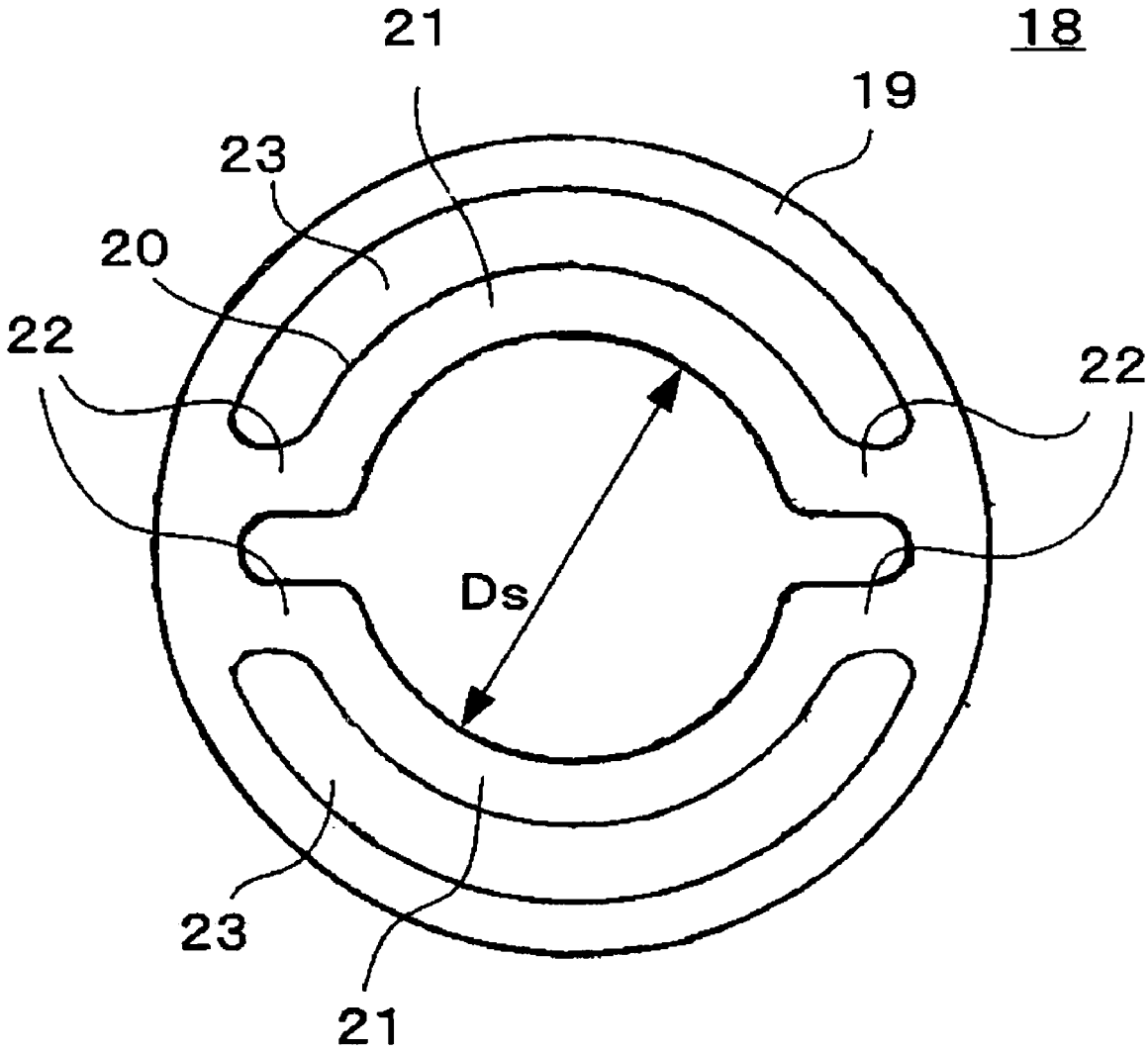
FIG. 4 is a plain view showing a slip plate assembled in the slip gear apparatus of FIG. 3.

As shown in FIG. 4 in detail, the slip plate 18 has an annular portion 19 formed around the outer periphery thereof and a spring portion 20 disposed inward of the annular portion 19. The annular portion 19 is a portion engaged with a groove 16*b* of the driven gear 16. The spring portion 20 includes a pair of arch portions 21, which extend in a semi-circular shape, and bridge portions 22 that connect both the ends of the arch portions 21 to the annular portion 19. Slits 23 are formed in a circumferential direction between the arch portions 21 and the annular portion 19. Accordingly, when a force is exerted on the arch portions 21 in a radial direction, the bridge portions 22 are flexed and the arch portions 21 are deformed in the radial direction, thereby the spring portion 20 can be elastically expanded and contracted in the radial direction in whole.

As shown in FIGS. 2 and 3, a coupling portion 25 is formed under the pinion 17. The coupling portion 25 includes a shaft portion 25*a*, which is continuous to a pinion main body 17*a*, and a flange portion 25*b* which is continuous to a lower end of the shaft portion 25*a* and has a diameter larger than the shaft portion 25*a*. The shaft portion 25*a* and the flange portion 25*b* are divided into two portions across a slit 26 (refer to FIG. 3), thereby shaft portion 25*a* and the flange portion 25*b* can be elastically deformed in the radial direction. Accordingly, the flange portion 25*b* is contracted in the radial direction, caused to pass through the inner periphery of the slip plate 18, and then released in a state that the slip plate 18 is attached to the driven gear 16, thereby the shaft portion 25*a* can be engaged with the inner periphery of the spring portion 20 to attach the pinion 17 to the slip plate 18. With the above assembly operation, the driven gear 16 can be concentrically coupled with the pinion 17 through the slip plate 18.

The outside diameter da of the shaft portion 25*a* of the pinion 17 in a no load state (refer to FIG. 3) is set somewhat larger than the inside diameter Ds of the spring portion 21 of the slip plate 18 (refer to FIG. 4). Accordingly, when the pinion 17 is assembled to the slip plate 18, the shaft portion 25*a* is elastically deformed radially centrally, and the spring portion 25 of the slip plate 18 is elastically deformed radially outwardly, respectively, and the shaft portion 25*a* of the pinion 17 is pressed against the inner periphery of the slip plate 18 by a restoring force resulting from the elastic deformation. A friction force is exerted between the slip plate 18 and the pinion 17 according to a press force and a friction coefficient between the shaft portion 25*a* and the slip plate 18 at the time. With the above operation, a friction transmitting portion 30 is formed between the slip plate 18 and the pinion 17.

A bearing hole 27 is formed at the center of the pinion 17. As shown in FIG. 2, a gear shaft 31 is rotatably engaged with the bearing hole 27, thereby the whole slip gear apparatus 15 is rotatably supported in its entirety around the gear shaft 31.

Note that the materials of the driven gear 16, the pinion 17, and the slip plate 18 may be appropriately determined. For example, the driven gear 16 and the pinion 17 may be formed of resin, and the slip plate 18 may be formed of metal. Either the slip plate 18 will do, which can or cannot slip on the driven gear 16 in a circumferential direction. When the driven gear 16 is made of the resin and the slip plate 18 is made of the metal, respectively, the driven gear 16 may be integrated with the slip plate 18 by inserting the slip plate 18 a metal mold of the driven gear 16 as an insert part to mold the driven gear 16.

In the turning drive apparatus 10 arranged as described above, when the power is transmitted from the not shown motor to the pinion 13 through the intermediate gear 12, the driven gear 16 meshed with the pinion 13 is driven in rotation, the power of the rotation of the driven gear 16 is transmitted to the pinion 17 from the slip plate 18 through the friction transmitting portion 30, and the internal gear 14 meshed with the pinion 17 is driven in rotation, thereby the turret 3 is turned. When a turn torque exerted on the turret 3 from the outside of the tank model 1 by the manipulation of the turret 3 executed by a user, and the like, the pinion 17 makes a slip motion to the slip plate 18 in the friction transmitting portion 30. Accordingly, the pinion 17 makes a slip motion to the slip plate 18 at the friction transmitting portion 30, thereby the turret 3 is permitted to turn, as well as the gear train 11 is protected because the transmission of the torque from the driven gear 16 to the drive source side is prevented.

In the first embodiment, the driven gear 16 and the pinion 17 are disposed concentrically and both the gears 16 and 17 are coupled with each other by the slip plate 18 disposed around inner periphery of the driven gear 16. Therefore, the slip gear apparatus 15 can be formed in a size approximately the same as a case that the gears 16 and 17 are molded together of the resin, and thus the gear train 11 and accordingly the turning drive apparatus 10 can be arranged compact even if the friction transmitting portion 30 is built in the turning drive unit 10.

Second Embodiment

Figure 5:
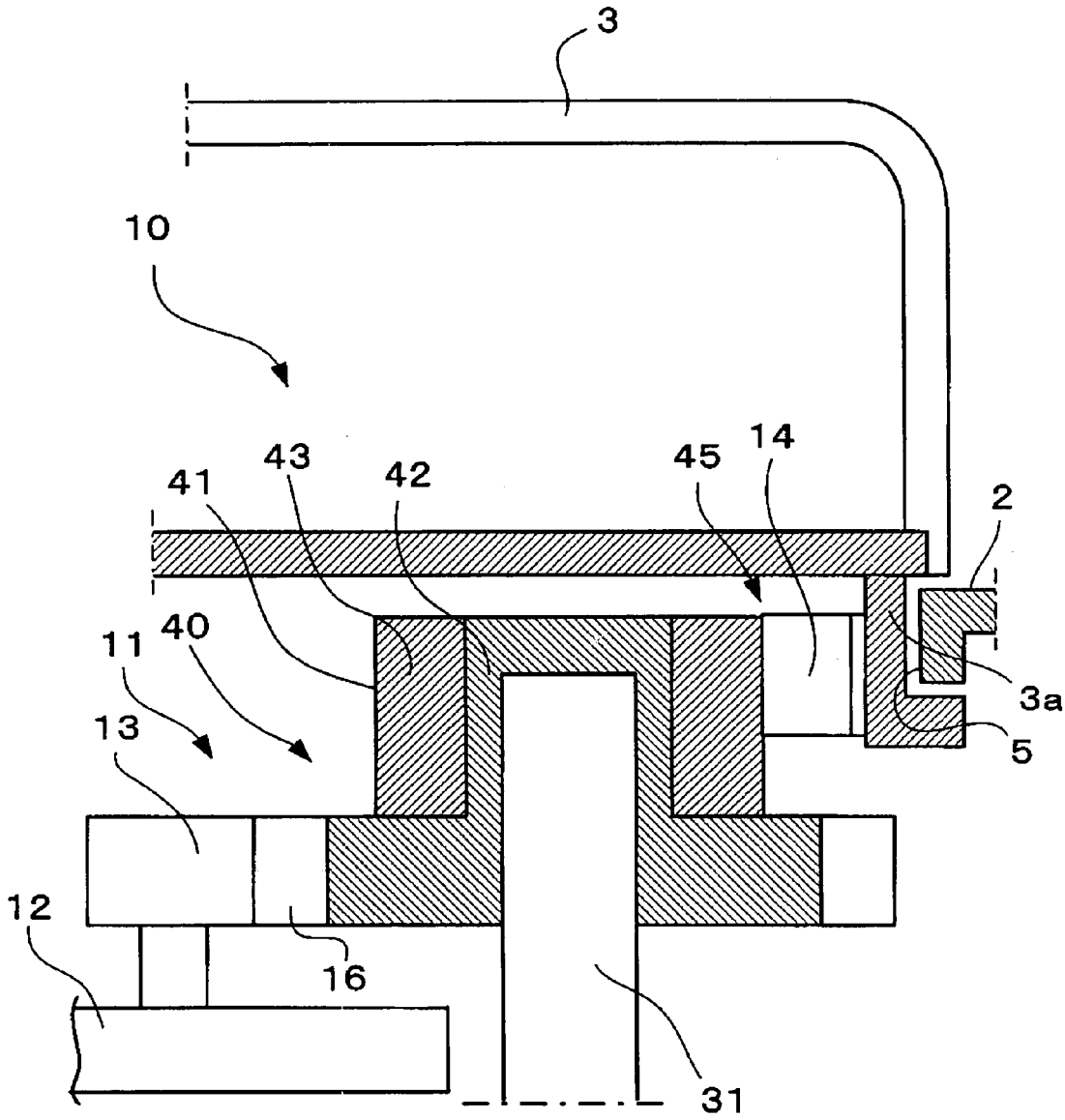
FIG. 5 is a sectional view showing a main portion of other turret turning drive apparatus.

FIG. 5 shows another arrangement of the friction transmitting portion. In this arrangement, a slip gear apparatus 40 making use of a friction wheel 41 is disposed with a gear train 11 in place of the slip gear apparatus 15 making use of the slip plate 18. The friction wheel 41 includes a small diameter shaft portion 42 molded integrally with a driven gear 16 and a friction ring 43 engaged with the outer periphery of the shaft portion 42. The friction ring 43 is made of an elastic member such as rubber, elastomer or the like and fastened to the shaft portion 42 with appropriate pressure so that it can be rotated together with the shaft portion 42. Further, the outer periphery of the friction ring 43 is pressed against the outer periphery of an internal gear 14 with appropriate pressure. With the above arrangement, a friction transmitting portion 45 is formed between the friction wheel 41 and the internal gear 14.

In the second embodiment as described above, a turret 3 can be turned by transmitting rotation from the slip gear apparatus 40 to the internal gear 14 making use of a friction force exerted between the friction ring 43 and the internal gear 14. Further, when a turn torque is exerted on the turret 3 from the outside of a tank model 1, the internal gear 14 makes a slip motion to the friction ring 43, thereby the turret 3 is permitted to turn as well as the gear train 11 is protected from the torque because the transmission of the torque from the driven gear 16 to a drive source side is prevented.

In the second embodiment, the arrangement can be simplified and manufactured at a low cost because it is enough only to mold integrally the driven gear 16 and the shaft portion 42 of resin and secure the friction ring 43 to the outer periphery of the shaft portion 42. However, since the friction ring 43 is made of the elastic member, there is a possibility that the friction ring 43 is worn caused by repeating the friction to the internal gear 14, and thus it is preferable to arrange the friction ring 43 to be replaced as a consumable part. In this respect, the first embodiment is more advantageous than the second embodiment because the friction transmitting portion 45 can be made of a material excellent in durability.

The present invention is by no means limited to the above embodiments and may be embodied in various modes. For example, the arrangement of the gear train and the position of the friction transmitting portion are not limited to the illustrated examples and may be appropriately modified. A friction transmission unit making use of power transmission by a belt and the like and a training-around type power transmission unit may be interposed between the drive source and the movable portions to be turned, in addition to the gear train. The present invention can also be applied to various movable portions to be turned provided with models, not only to the turret of the tank model.

What is claimed is:

1. A turning drive apparatus for a model for turning a movable portion of the model by transmitting power from a drive source to the movable portion, comprising:

a gear train for transmitting power to the movable portion, said gear train comprising:

a pair of gears; and a friction transmitting portion being interposed between the pair of gears, the friction transmitting portion using friction force to transmit the power, wherein the pair or gears are concentrically coupled with each other through a common slip plate;

any one of the pair of gears has a hollow portion at a center side of gear, an outer circumference of the slip plate is engaged with an inner periphery of the hollow portion; and the other gear is combined to the slip plate so that the other gear makes a slip motion in a circumferential direction, thereby the friction transmitting portion is interposed between the other gear and the slip plate; wherein a radially deformable spring portion disposed on a center side of the slip plate, an inner circumference of the spring portion is engaged with an outer circumference of an axis of the other gear by forming so that a radius of the outer circumference of the axis of the other gear is slightly longer than a radius of the inner circumference of the spring portion.

2. A slip gear apparatus disposed in a gear train for turning a movable portion of a model by transmitting power from a drive source to the movable portion, comprising:

a slip plate; and a pair of gears being coupled concentrically with each other through the slip plate, wherein any one of the pair of gears is combined to the slip plate so that the gear makes a slip motion in a circumferential direction, and a friction transmitting portion is interposed between the gear and the slip plate; wherein a radially deformable spring portion disposed on a center side of the slip plate, an inner circumference of the spring portion is engaged with an outer circumference of an axis of the other gear by forming so that a radius of the outer circumference of the axis of the other near is slightly longer than a radius of the inner circumference of the spring portion; and the other gear of the pair of gears has a hollow portion at a center side of the gear, an outer circumference of the slip plate is engaged with an inner periphery of the hollow portion.

* * * * *

UNITED STATES PATENT AND TRADEMARK OFFICE

CERTIFICATE OF CORRECTION

PATENT NO. : 7,434,490 B2
APPLICATION NO. : 10/510185
DATED : October 14, 2008
INVENTOR(S) : Ryoji Hayashi It is certified that error appears in the above-identified patent and that said Letters Patent is hereby corrected as shown below:

On the Title page,

Assignee: Konami Corporation, Tokyo (JP)

Delete the phrase "Konami Corporation" and insert --Konami Digital Entertainment Co., Ltd.--.

Signed and Sealed this

Twelfth Day of October, 2010

David J. Kappos

David J. Kappos
*Director of the United States Patent and Trademark Office*